United States Patent [19]

White

[11] 4,169,432

[45] Oct. 2, 1979

[54] INTEGRATED PCV VALVE AND OIL FILLER CAP

[75] Inventor: Leslie G. White, Hutton, England

[73] Assignee: Ford Motor Company, Dearborn, Mich.

[21] Appl. No.: 6,966

[22] Filed: Jan. 26, 1979

Related U.S. Application Data

[63] Continuation of Ser. No. 783,506, Mar. 31, 1977, abandoned.

[51] Int. Cl.[2] ..... F01M 13/02; F02M 25/06

[52] U.S. Cl. ..... 123/41.86; 123/119 B

[58] Field of Search ..... 123/41.86, 119 B

[56] References Cited

U.S. PATENT DOCUMENTS

| | | | |
|---|---|---|---|
| 3,494,339 | 2/1970 | Fernandez | 123/119 B |
| 3,550,570 | 12/1970 | Watson | 123/119 B |
| 3,589,347 | 6/1971 | Sawada | 123/119 B |
| 3,664,368 | 5/1972 | Sweeney | 123/119 B |
| 3,677,240 | 7/1972 | Sarto | 123/119 B |

*Primary Examiner*—Charles J. Myhre
*Assistant Examiner*—Jeffrey L. Yates
*Attorney, Agent, or Firm*—Robert E. McCollum; Clifford L. Sadler

[57] ABSTRACT

An internal combustion engine oil filler cap has a positive crankcase ventilation (PCV) valve assembly integral with it so that crankcase vapors normally flow at below predetermined flow volumes directly into the engine inlet-manifold, while clean air from the engine air cleaner assembly flows into the crankcase past a control valve; the crankcase vapors at higher flow rates opening a bypass valve to flow vapors simultaneously into the inlet manifold and also the air cleaner assembly, the control valve at this time closing.

1 Claim, 5 Drawing Figures

INTEGRATED PCV VALVE AND OIL FILLER CAP

This is a continuation of application Ser. No. 783,506, now abandoned, filed Mar. 31, 1977.

This invention relates to crankcase breathers for internal combustion engines.

It is known that with reciprocating piston internal combustion engines a certain amount of gas, known as blow-by gas, is blown past the piston rings and enters the crankcase. At small throttle openings this blow-by gas is not troublesome but at large throttle openings the amount of blow-by gas is such that considerable pressures can develop in the crankcase. These pressures can cause oil leaks by forcing open oil seals. A way must therefore be found to dissipate these pressures.

A common solution to this problem is to provide a crankcase breather valve in the form of a one way valve which permits the blow-by gas to be vented from the crankcase. The valve outlet is commonly connected to the air cleaner or inlet manifold of the engine to prevent (a) oil mist contamination of the engine compartments and (b) hydrocarbon pollution of the atmosphere.

It is further known that if some way can be found to ventilate the crankcase with clean air the life of the engine oil can be greatly prolonged. A known arrangement for achieving this is to provide a first hose connection between an outlet port from the crankcase and the intake manifold and a second hose connection between the air cleaner and the interior of the rocker cover. A flow control valve and an oil separator are normally fitted to the crankcase outlet port and the first hose connection is fitted to the outlet of this valve.

Under part throttle conditions, the suction developed by the intake manifold is effective not only to draw the blow-by gas from the crankcase through the flow control valve and the first hose connection to the intake manifold but is also effective to draw clean air from the air cleaner through the second hose connection, the rocker cover and oil drain holes into the crankcase from whence it is sucked into the intake manifold with the blow-by gas via the flow control valve and first hose connection. In this manner, the engine crankcase is ventilated with clean air.

Under full throttle conditions, the flow control valve is unable to allow all of the blow-by gas to pass and the residual blow-by gas passes up the oil drain holes in the cylinder head into the rocker cover. This gas is then sucked along the second hose connection through the air cleaner and into the carburetor and intake manifold.

While this arrangement is reasonably satisfactory for in-line engines, problems can occur when the engine is arranged transverse to the longitudinal axis of a vehicle (transverse engines). In the latter case, when sharp corners are taken by the vehicle, the oil in the sump will surge towards the end of the crankcase on the outside of the corner. This causes the crankshaft and conrods to dip into the oil and produce a large amount of oil mist so that the blow-by gas which passes up the breather hose will be overladen with oil. Oil will also be forced into the hose connection leading from the rocker cover to the air cleaner as a result of the oil surge towards the end of the crankcase.

This oil not only can reach the filter element in the air cleaner and thus block the filter but also can be sucked into the intake manifold and may in time interfere with the running of the engine by causing excessive carbon deposits. In extreme cases, the oil can flood out of the air cleaner and onto the outside of the engine where it may reach the exhaust manifold with the concomitant risk of fire.

A further disadvantage of the known arrangement lies in the high cost of the flow control valve and oil separator which must be fitted to the outlet port from the crankcase. If this valve is dispensed with, satisfactory oil ventilation cannot be achieved because far too much air/blow-by gas will be drawn into the intake manifold at small throttle openings and good carburation will not be achieved. Conversely, if this first hose is restricted too much then the hose cannot pass sufficient blow-by gas at full throttle so that most of the blow-by gas will pass through the rocker cover and second hose connection into the air cleaner. This has the previously described effect of blocking the filter element with the oil carried by the excess blow-by gas.

The present invention aims to overcome the above-mentioned disadvantages.

According to one aspect of the present invention, there is provided an oil filler cap for an internal combustion engine having crankcase ventilation means comprising a restricted outlet adapted to be connected to an intake manifold of said engine for permitting the passage of gas from the crankcase to the intake manifold up to a predetermined maximum rate of flow and a valve adapted to open in the event of gas pressure in the crankcase exceeding a predetermined value and adapted to be connected to the air cleaner and/or intake manifold of the engine.

Preferably, the restricted outlet is provided in a tube extending tangentially from the tubular spigot of said filler cap which is adapted to be fitted to a rocker cover of an engine.

According to a preferred embodiment of the invention, a further valve is provided in the cap and the outlet from said further valve takes the form of a tube adapted to be connected to a port in the crankcase of the engine.

The said further valve may comprise a valve member located in a valve chamber between two valve seats, the valve member being normally held against one of the seats by a spring.

Another aspect of the present invention provides an oil filler cap for an internal combustion engine comprising a body having a tubular spigot for fitting to a rocker cover of an engine, a first tube leading from the spigot, a restricted outlet in the tube, a first valve located at the upper end of the spigot, a second tube leading from the body, a second valve located in said second tube, a cover adapted to be fitted to said body and a third tube leading from the cover.

The invention will now be further described, by way of example, with reference to the accompanying drawings, in which.

Figure 1:
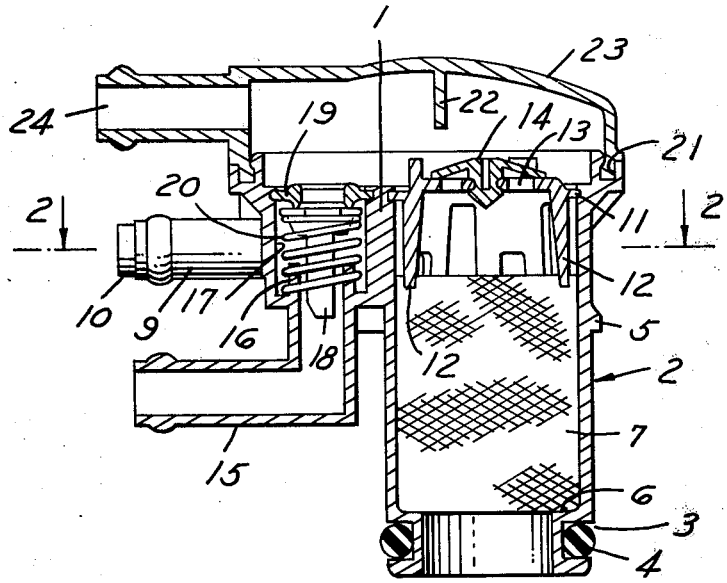
FIG. 1 is a section through one embodiment of an oil filler cap incorporating crankcase ventilation means according to the invention.
Figure 2:
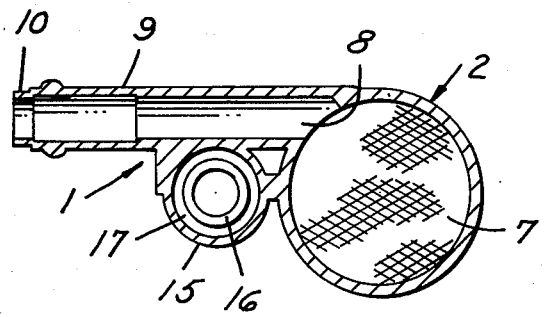
FIG. 2 is a section taken along the line II—II in FIG. 1 in the direction of the arrows but with the valves omitted for the sake of clarity.

Reference will first be made to FIGS. 1 and 2 of the drawings in which the oil filler cap comprises a body 1 having a tubular spigot 2 which is provided with an annular channel 3 adjacent its lower end for the reception of a rubber O-ring 4. The spigot 2 is designed to be inserted in an upstanding tubular projection (33 in FIGS. 3 and 4) of a rocker cover 32 (not shown in FIGS. 1 and 2) in known manner and is provided with an external flange 5 designed to abut the top of the tubular projection of the rocker cover. The rubber O-ring 4 serves as a seal to prevent the egress of oil from the rocker cover.

The tubular spigot 2 is further provided internally with a shoulder 6 against which the lower end of a wire mesh filter element 7 is pressed. Extending tangentially to the spigot 2 from a port 8 located above the filter element 7 is a tube 9 which, as can be seen from FIG. 2, is formed in one piece with the filler cap body 1. A restricted outlet member 10 is fitted into the end of the tube 9.

A disc 11 having a plurality of legs 12 is fitted to the upper end of the tubular spigot 2, the legs 12 serving to press the filter element 7 against the shoulder 6, and ensuring that the filter element cannot block the port 8. The disc is provided with a series of apertures 13 which are normally closed by a flexible material umbrella valve 14. This valve is made of a flexible material which is resistant to oil and the gasses of combustion and which is effective to seal the apertures 13 unless subjected to a pressure of a predetermined value. The disc 11 is omitted from the section of FIG. 2 in order to show clearly the location of the port 8.

A further tube 15 extends from the underside of the body 1 and terminates within the body 1 in a valve chamber 17. The end 16 of the tube 15 is formed as a valve seat for a purpose to be hereinafter described. The stem of a valve member 18 is located in the tube 15 and is urged away from the valve seat 16 and into engagement with a valve seat 19 by a coil spring 20 located in the valve chamber 17. The valve seat 19 takes the form of an apertured disc which is secured in the body 1. The body 1 is further provided with an annular recess 21 in its upper rim which is adapted to receive a cover 23 having a further tube 24 extending from a side wall thereof. The cover is provided with an upstanding projection 22 to ensure that the disc 11 cannot be fitted incorrectly in the spigot 2 because if the legs 12 project upwards they will engage the projection 22 and thus prevent the cover 23 from being fitted onto the body 1.

Figure 4:
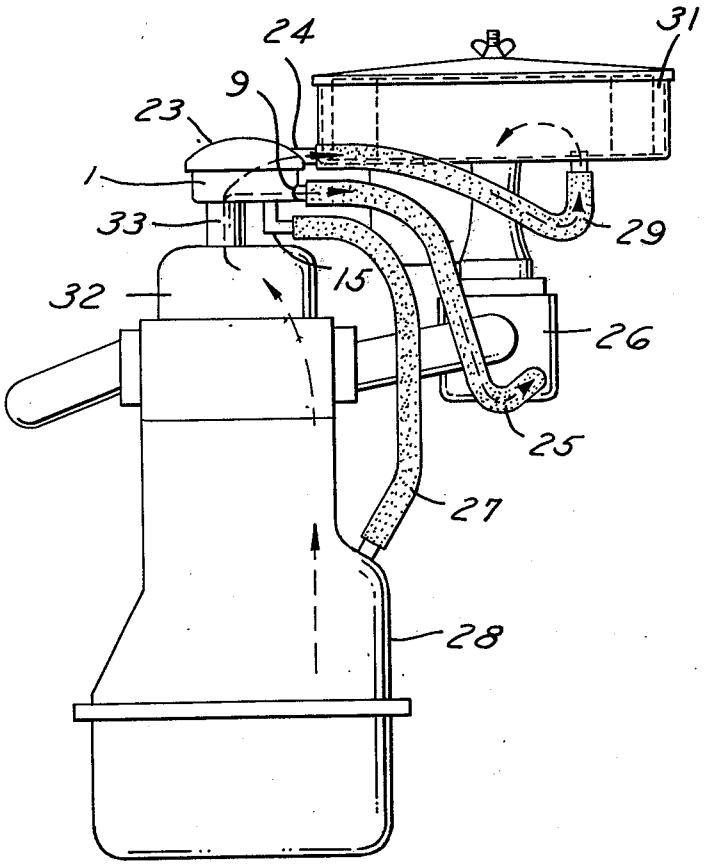
FIGS. 3 and 4 are diagrams showing the operation of the crankcase ventilation means according to the invention.
Figure 3:
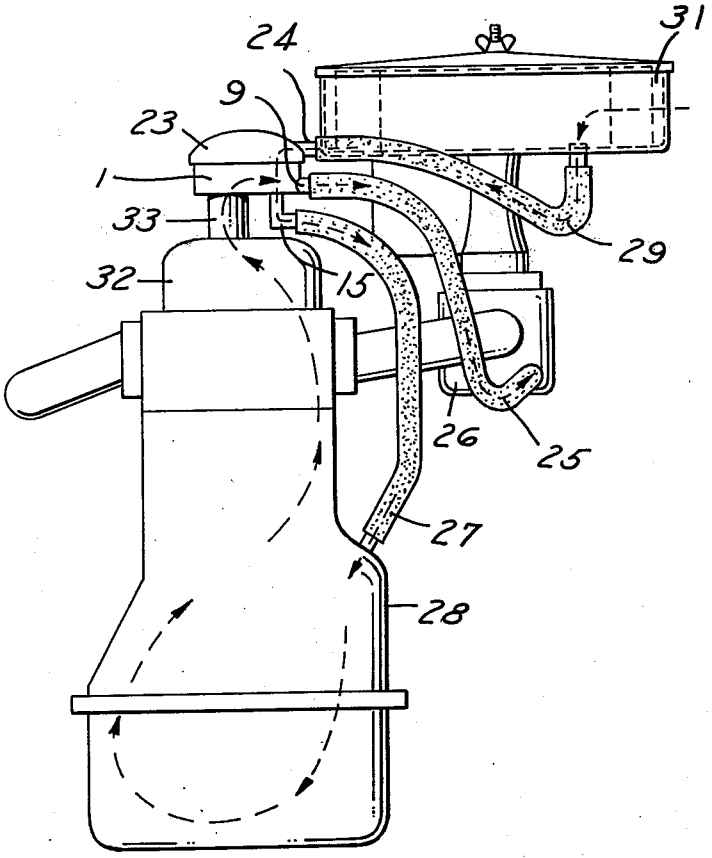

The tubes 9, 15 and 24 are so designed that hoses can readily be pushed over them and secured thereon. As shown in FIGS. 3 and 4, the tube 9 is connected by a hose 25 to an intake manifold 26 of an engine, the tube 15 is connected by a hose 27 to the crankcase 28 and the tube 24 is connected by a hose 29 to the air cleaner 31. FIGS. 3 and 4 show the flow of gas when the engine is running, the full arrows indicating the flow of clean air and the dotted arrows showing the flow of blow-by and other oil laden gas from the crankcase.

FIG. 3 shows the operation during idle running and part throttle openings of the engine. Under these conditions, the intake manifold generates good suction but there is little blow-by gas. However, the restricted outlet member 10 in the tube 9 ensures that a large crankcase depression is not developed by the intake manifold but its size is sufficient to draw clean air from the air cleaner 31 through the hose 29 and tube 24 into the space enclosed by the body 1 and cover 23. The spring 20 is very light so that the suction produced by the intake manifold is sufficient to force the valve member 18 off the seat 19 to open the valve and permit the passage of clean air through the tube 14 and hose 27 into the crankcase 28 where the air serves to prevent contamination of the oil in the sump. The oil-laden air and any blow-by gas in the crankcase is sucked up the oil drain holes leading to the rocker cover 32 and passes up a tube 33 projecting from the rocker cover into the tubular spigot 2 which is fitted into the tube 33. On entering the tubular spigot 2, the air and gas passes through the filter element 7 and through the port 8 into the tube 9, from whence it is sucked through the restricted outlet member 10 into the hose 25 and thus to the intake manifold 26.

This state of affairs continues with increasing throttle openings until the volume of blow-by gas is such that the restricted outlet member 10 cannot pass all of the gas. At the same time, the intake manifold creates a decreased suction effect but since the restricted outlet member 10 will allow only a limited amount of gas to pass through it, the increased blow-by must be disipated to the air cleaner. There is thus less clean air available for ventilating the crankcase. Pressure begins to build up in the crankcase on account of the restricted flow through the outlet opening 10 and the spring 20 is effective to force the valve member 18 against the seat 19 to close this valve. When the pressure in the crankcase and thus in the rocker cover and spigot 2 reaches a predetermined value, the umbrella valve 14 is forced away from the disc 11 to permit the blow-by gas to pass through the apertures 13 into the space between the body 1 and cover 23 and then along the tube 24 and hose 29 and into the air cleaner 31 from whence it is sucked into the engine.

With the known arrangements for crankcase ventilation, it has been necessary to provide the air cleaner with a flame trap so that, in the event of a backfire, flames from the intake manifold cannot pass through the air cleaner and into the crankcase where ignition of the combustible gases contained therein would cause an explosion with consequent damage to the engine and possible risk of injury and fire. Such a flame trap in the air cleaner is unnecessary with the arrangement according to the invention. This is because the high pressure of the blowback which enters the air cleaner from the intake manifold and then passes along the hose 29 and into the space between the body 1 and cover 23 is effective to force the valve member 18 to close on the valve seat 16 and thus prevent the flames from reaching the crankcase.

The body 1 is preferably made of a plastics material and the tubular spigot 2 and tubes 9 and 15 are desirably moulded integrally with the body. The disc 11 and valve seat 19 are also desirably made of plastics material and may be secured in position on the body 1 by hot swaging or other suitable means.

A suitable material for the body 1 is polypropylene. It has been found that over a period of some years, this material expands whereby if the filler cap is made so that, when new the tubular spigot 2 is a tight fit in the rocker cover tube 33, it may be impossible to draw the filler cap out of the tube 33 after a prolonged period of use. A further feature of the present invention aims to overcome this problem by providing a series of ribs on the outer surface of the tubular spigot 2. The ribs extend from the flange 5 to approximately one third of the way down said spigot 2 and then taper inwardly over the middle third of the tubular spigot to terminate flush with its outer surface. When the spigot 2 is pushed into the tube 33, the ribs engage with the side wall of the tube to hold the filler cap in position. Any expansion of the spigot material can take place between the ribs without affecting the fitting or removal of the spigot in or from the rocker cover tube.

Figure 5:
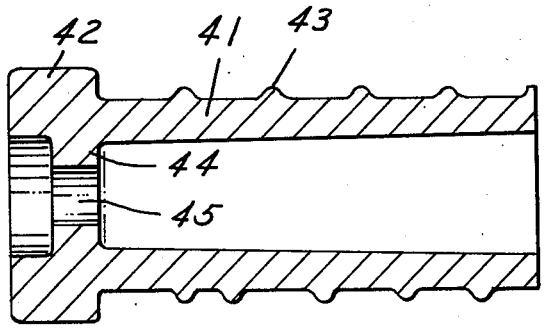
FIG. 5 shows, to an enlarged scale, a restricted outlet member for insertion in the connection to an intake manifold.

A preferred form of the restricted outlet member 10 is illustrated in FIG. 5 of the drawings. As shown this member comprises a tube 41 having a flange 42 at one end and a coarse screw-thread 43 on its outer surface. The tube tapers inwardly from the end remote from the flange 42 to a region where an annular shoulder 44 is provided which shoulder defines a restricted orifice 45. This construction ensures that the rate of flow through the tube cannot exceed a predetermined value. The tube 41 can be pushed into the tube 9 and the wall of the tube 9 will conform with the coarse screw-thread 43. The flange 42 is provided with flats which can be engaged by a spanner so that the tube 41 can be screwed out of the tube 9 for replacement.

It will be seen that by incorporating the crankcase ventilation means for an engine in the oil filler cap considerable advantages accrue in that all of the necessary valves are incorporated in a single unitary component which is cheap to produce, which can readily be replaced in the case of malfunction or failure, and which overcomes the disadvantages of the prior arrangements.

I claim:

1. An oil filler cap integrated with a positive crankcase ventilation (PCV) valve assembly for use with an automotive type internal combustion engine having an air cleaner assembly for the supply of clean air to a carburetor induction passage connected to the intake manifold of the engine, comprising:

a hollow-closed one-piece housing adapted to be inserted into the inlet of a tube projecting from the engine through which oil may be added to the engine and through which crankcase vapors from the engine may flow out of the engine into the housing, the housing having first means connecting the inlet tube to the engine intake manifold for the flow of crankcase vapors normally therebetween below a predetermined flow pressure level, the housing having second means connecting the air cleaner assembly to the engine crankcase for the flow of clean air to the crankcase at pressures higher than the intake manifold below the said predetermined flow pressure level, the housing having further means operable above the predetermined flow pressure level to connect the crankcase vapors to the air cleaner in parallel flow arrangement with the flow of vapors to the intake manifold, the first means including a cylindrical filter member open at opposite ends and adapted to have one end insertable into the inlet of the tube to receive crankcase vapors therefrom, the further means comprising a first one-way check valve closing the opposite end, first conduit means connecting the crankcase vapors through the filter member directly to the intake manifold at all times bypassing the check valve, the second means including a second conduit in side-by-side relationship to the filter member and a cover common to the filter member and second conduit and defining a chamber in the housing having a first connection to the filter through the first check valve end of the filter past the first check valve in an open condition, the chamber having a second connection to the crankcase through the second conduit past a second check valve comprising means including a spring closed valve means openable by pressure thereagainst in the chamber at a greater pressure level than in the crankcase, the chamber having additional conduit means connecting the chamber to the air cleaner assembly whereby flow of crankcase vapors below a first predetermined rate effects flow through the filter only into the intake manifold with the first check valve closed and the second check valve opened by the flow of air from the air cleaner to the crankcase and whereby flow of crankcase vapors above a predetermined rate effects opening of the first check valve for the simultaneous flow of vapors into the air cleaner assembly as well as the intake manifold and the closing of the second check valve by the equalization of the pressure level of the vapors acting on opposite sides of the valve means.

* * * * *